US005429431A

United States Patent [19]

Olson et al.

[11] Patent Number: 5,429,431

[45] Date of Patent: Jul. 4, 1995

[54] WIRE MANAGEMENT SYSTEM AND ASSSEMBLIES THEREFOR

[75] Inventors: Ogden R. Olson, Muscatine; Clayton C. Schmidt, Wilton, both of Iowa

[73] Assignee: Hon Industries Inc., Muscatine, Iowa

[21] Appl. No.: 927,591

[22] Filed: Aug. 10, 1992

[51] Int. Cl.[6] ..... A47B 77/08

[52] U.S. Cl. ..... 312/223.6; 108/23

[58] Field of Search ..... 312/223.6, 194; 174/48; 16/2; 108/23

[56] References Cited

U.S. PATENT DOCUMENTS

| | | |
|---|---|---|
| 945,753 | 1/1910 | Chamberlain et al. . |
| 1,786,823 | 12/1930 | Carrington et al. . |
| 3,135,535 | 6/1964 | Shepard . |
| 3,598,900 | 8/1971 | Drake . |
| 3,635,174 | 1/1972 | Ball et al. . |
| 3,783,175 | 1/1974 | Timmons . |
| 3,802,146 | 4/1974 | Tacke et al. . |
| 3,838,202 | 5/1974 | Konig . |
| 3,852,927 | 12/1974 | Birum, Jr. . |
| 3,857,136 | 12/1974 | Dean . |
| 3,873,758 | 3/1975 | VanGessel et al. . |
| 3,883,196 | 5/1975 | Mohr et al. . |
| 3,890,023 | 6/1975 | Mohr et al. . |
| 4,053,701 | 10/1977 | Ogilvie et al. . |
| 4,066,305 | 1/1978 | Gazarek . |
| 4,094,256 | 6/1978 | Holper et al. . |
| 4,125,238 | 11/1978 | Tanaka . |
| 4,163,867 | 8/1979 | Breidenback . |
| 4,296,579 | 10/1981 | Proud . |
| 4,296,981 | 10/1981 | Hildenbrandt et al. . |
| 4,323,291 | 4/1982 | Ball . |
| 4,372,629 | 2/1983 | Prospst et al. . |
| 4,406,101 | 12/1983 | Heidman . |
| 4,422,385 | 12/1983 | Rutsche et al. . |
| 4,520,976 | 6/1985 | Cournoyer et al. . |
| 4,535,703 | 8/1985 | Henriott et al. . |
| 4,566,241 | 1/1986 | Schneller . |
| 4,581,869 | 4/1986 | Reuter . |
| 4,627,364 | 12/1986 | Klein et al. . |
| 4,654,756 | 3/1987 | Wilson et al. . |
| 4,730,363 | 3/1988 | Asbaghi . |
| 4,734,826 | 3/1988 | Wilson et al. . |
| 4,762,072 | 8/1988 | Boundy . |
| 4,792,881 | 12/1988 | Wilson et al. . |
| 4,843,707 | 7/1989 | Lake, Jr. et al. . |
| 4,883,330 | 11/1989 | Armstrong et al. . |
| 4,884,513 | 12/1989 | Newhouse et al. . |
| 4,948,205 | 8/1990 | Kelley . |
| 5,024,167 | 6/1991 | Hayward . |
| 5,050,267 | 9/1991 | Quest . |
| 5,083,512 | 1/1992 | Newhouse et al. . |
| 5,121,698 | 6/1992 | Kelley . |
| 5,130,494 | 7/1992 | Simonton et al. . |

FOREIGN PATENT DOCUMENTS

| | | |
|---|---|---|
| 2130877 | 6/1984 | United Kingdom . |

*Primary Examiner*—Kenneth J. Dorner
*Assistant Examiner*—Gerald A. Anderson
*Attorney, Agent, or Firm*—Jones, Day, Reavis & Pogue

[57] ABSTRACT

A wiring management system for use in a furniture component includes a wiring management assembly with one or more wire pass through subassemblies for routing wiring therethrough. At least one of the pass through subassemblies comprises a plurality of separable covers for concealing an electrical appliance located on a support structure proximate to the pass through subassembly, while providing ready access to the electrical appliance. The pass through subassemblies preferably include a removable rosette piece for routing wiring therethrough.

9 Claims, 6 Drawing Sheets

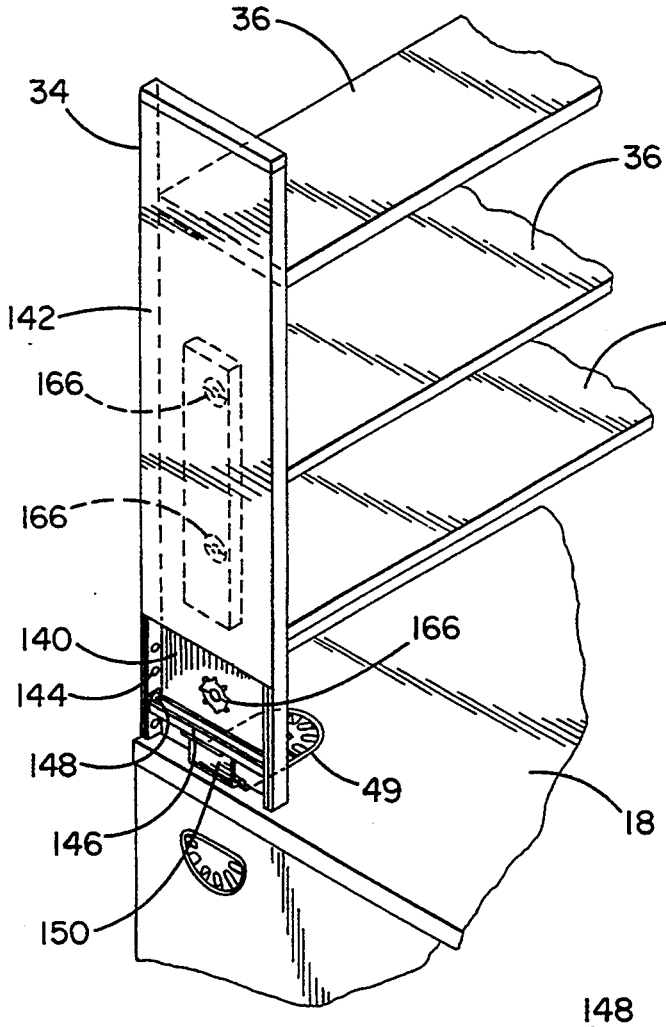
FIG. 6
FIG. 7
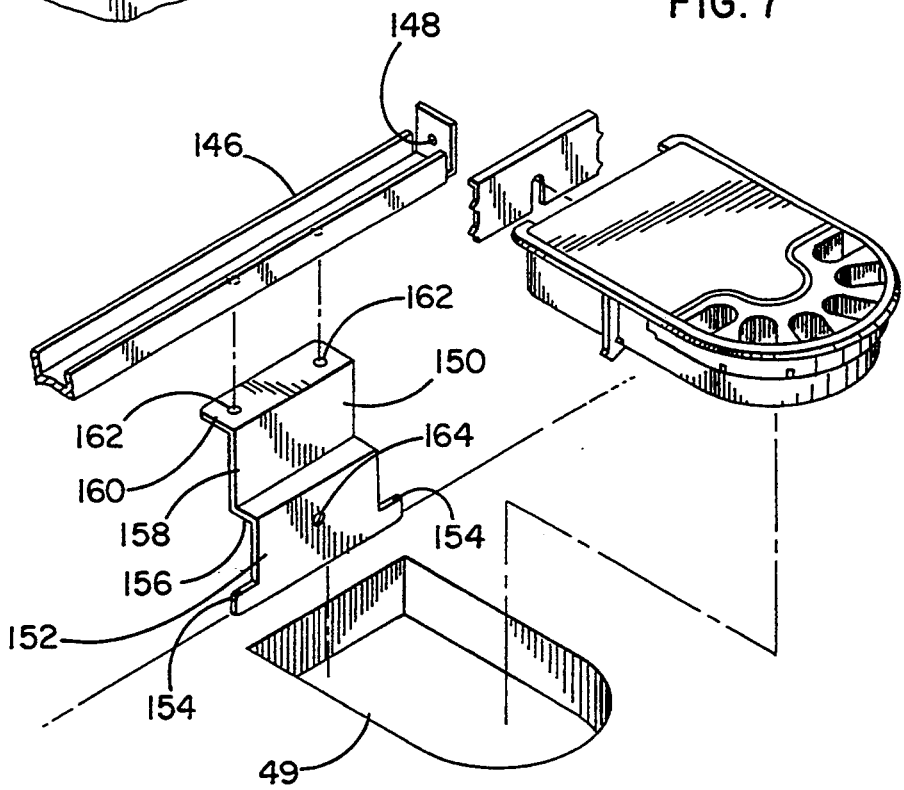

WIRE MANAGEMENT SYSTEM AND ASSSEMBLIES THEREFOR

FIELD OF THE INVENTION

This invention relates generally to wire management in furniture components to provide electrical communication to and among various electrical units contained therein. More particularly, the invention relates to a wiring management system and wire guide insert assemblies used in that system which use a wire pass through frame and one or more separable closure pieces adapted for placement within the frame. The invention provides a simple, but effective manner of routing wiring to various locations in an office space while at the same time permitting ready access to the wiring.

BACKGROUND OF THE INVENTION

The use of wire management in modular furniture components in an office environment provides routing of power and other cabling to various electrical appliances in the office space to permit thereby efficient use of that space. However, the installation and maintenance requirements of wire management systems have posed practical difficulties. Principle among these difficulties is the interconnection of various electrical components in order to meet the demands of the office space, while at the same time effectively concealing the wiring and electrical apparatus from view. With the widespread use of data storage and other electrical equipment, it is also important to employ some type of electrical current surge protection to prevent damage to or even destruction of the electrical equipment. Accordingly, an electrical power strip or other electrical appliance having a plurality of receptacles connected through surge protection to a power source are typically utilized. These appliances, however, are somewhat unattractive and awkward if exposed in the office space. In addition, they consume considerable real estate and can encumber presented surfaces.

It is also desirable to provide some degree of flexibility in the wire management system such that wiring may be easily rerouted in the office space to meet the changing needs of users. The wiring should also be routed in such a manner to avoid clutter. It is therefore important to have ready access to the electrical appliance as well as ease of installation of the appliance within the wire management system.

Heretofore, wire management systems have typically comprised prefabricated wiring channels or troughs formed along the length-wise dimension of a desk unit beneath the desk top surface. These channels provide a location through which the wiring is manually routed. Such channels often include a removable or hinged top cover to permit access to the wiring or receptacles and the like in the wiring trough. Such systems provide adequate concealment of the wiring when installed, however, because of the size of the channel, they do not generally account for placement of surge protection or similar sized electrical appliances within the channels. In addition, not only do these arrangements present an opening in the top center of the disk unit, but the wiring channels traverse the knee space of the desk unit as well, thereby interfering with the work space.

SUMMARY OF THE INVENTION

Accordingly, it is an object of the present invention to provide improved wire management in a furniture unit. More specifically, it is an object of the present invention to provide a novel mode for routing electrical wiring to and throughout office furniture components and at the same time maintaining an attractive appearance of the components.

It is another object of the invention to provide a wire guide insert assembly useful in an office wiring system having one or more removable portions for ready accessibility to an electrical appliance located within a furniture component which avoids undue interference of the work space.

It is still another object of the present invention to provide wire management with an assembly that may be easily installed, requiring far less time than known assemblies, yet which provides a high degree of durability and reliability.

These and other additional objects are accomplished in a wire management system particularly useful in an office environment. Structurally, a wire management system of the present invention is used in a furniture component having a top surface with a top opening and at least one peripheral side with a side opening. A wire management assembly includes a first wire guide insert subassembly located in the top opening, a second wire guide insert subassembly located in at least one of the peripheral side openings, and a support structure for supporting an electrical appliance proximate to the wire guide insert subassemblies. In a preferred embodiment, the first wire guide insert subassembly includes a U-shaped wire pass through frame or grommet disposed in the top or presented surface of the furniture component. A removable cover sized for placement within a channel formed in the grommet and a wire guide separator coact to conceal the interior of the furniture component while being readily removable to permit access to the support structure and the electrical appliance. Similarly, the second wire guide insert subassembly preferably includes a generally D-shaped wire guide frame or grommet in the peripheral side surface of the furniture component. A wire separator is removably engaged with the grommet and permits wiring to pass therethrough. Subjacent the first and second wire guide inserts is the support structure which supports the electrical appliance.

Preferably, the wiring management system also provides for mounting a super structure such as a hutch unit to the vertical component. In this regard, a mounting bracket arrangement includes a T-shaped bracket configured to mate with a supporting bracket of the hutch unit on one end thereof. The other end includes latch ears and is adapted to fit within the opening in the top surface of the furniture component by placement in the grommet frame with its latch ears extending therebeneath to avoid the use of a securing screw in the top surface.

BRIEF DESCRIPTION OF THE DRAWINGS

FIG. 6 is a fragmentary isometric view of the furniture component of FIG. 1 illustrating connection between a desk unit and super structure.

FIG. 7 is an exploded isometric view of the desk unit and super structure of FIG. 6 illustrating an attaching bracket arrangement for securing the desk unit with the super structure.

DETAILED DESCRIPTION OF THE DRAWINGS

The following detailed description will permit a more complete understanding of this invention. However, the embodiments described below are simply examples of the invention and the invention is not limited to these embodiments. Furthermore, the drawings are not necessarily to scale. In certain instances, details have been omitted which are not necessary for an understanding of the invention. Generally, the present invention relates to a wiring management system and assemblies used therein and is intended to be used in office furniture components or other units in an environment wherein the components can be readily changed or reconfigured.

Figure 1:
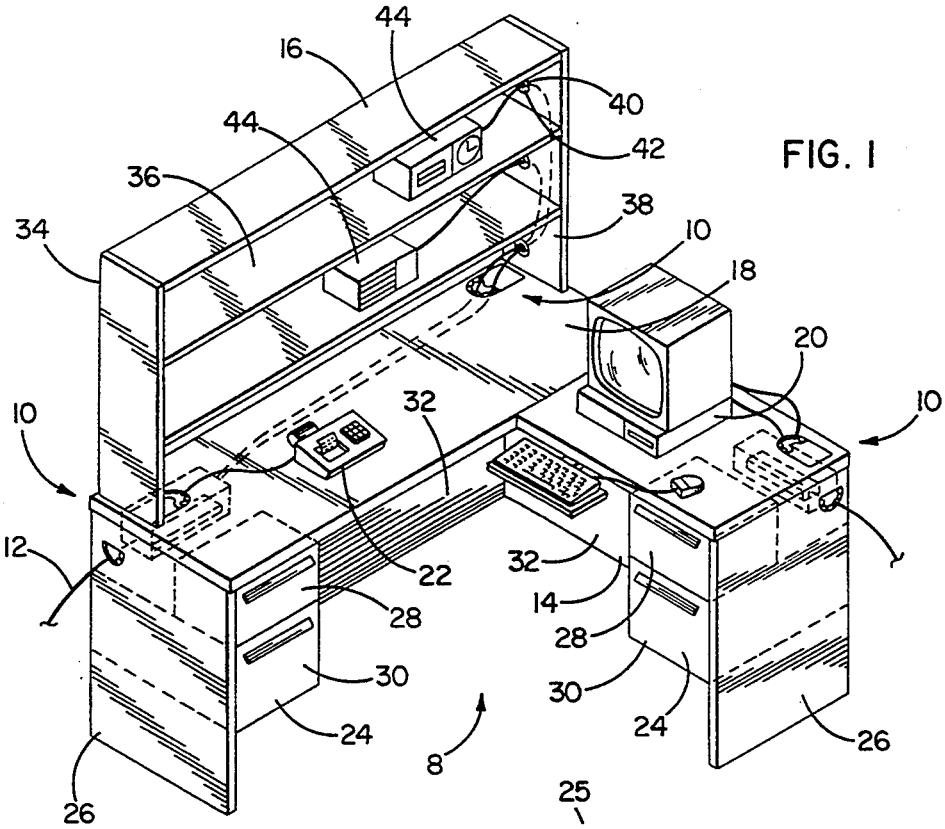
FIG. 1 is an isometric view of a furniture component utilizing the wiring management system according to the present invention.

Turning now to the drawings, FIG. 1 illustrates an isometric view of a desk unit 8 using the wiring management system of the present invention. While a preferred embodiment of the wiring management system is described hereinafter in conjunction with a desk unit, it should be understood that this system can also be incorporated into other furniture components with appropriate modification. The desk unit 8 includes at least one wire management assembly 10 but typically includes a plurality of such assemblies. The wire management assemblies 10 enable electrical wiring 12 to be efficiently routed from a desired point of origination to a point of termination while permitting easy access to the interior of the desk and efficiently concealing the wiring, as described in greater detail below. The desk unit 8 illustrated in FIG. 1 is configured with a return 14 as well as a super structure or stack-on hutch unit 16. A desk top 18 which preferably is fabricated of a wood or chip board laminate, provides a presented surface upon which various electrical components may be placed.

In FIG. 1, a personal computer 20 including a display and other equipment as well as a mathematical calculator 22 are shown resting on the presented surface. The desk unit 8 and also the return 14 are supported by pedestal assemblies 24 which include vertical legs 25 (see FIG. 2) hidden from view by side panels 26 located about the peripheral sides of the desk and return units. The pedestal assemblies 24 also include upper and lower sliding drawers 28 and 30. The upper drawers 28 are preferably somewhat shorter than the lower drawers 30 to accommodate the wire management assemblies 10, as described below. In addition, the desk unit 8 and return 14 typically include a rear panel 32 or modesty panel extending from the side panels 26 along the back side of the desk unit 8 and return 14, respectively. The side panels, sliding drawers and rear panels are fabricated of sheet metal in a preferred embodiment.

As noted above, the desk unit 8 also supports the stack-on hutch unit 16. The hutch unit 16 includes opposed vertical post assemblies 34 rigidly interconnected to the desk unit 8 with the use of an attaching bracket according to the invention (see FIG. 6), as described in greater detail below. The vertical post assemblies 34, in turn, support at least one shelf 36 in a manner known to those skilled in the art, but typically support a plurality of shelves 36. Each of the vertical post assemblies 34 provide an interior wire race (not shown) and include an inside surface 38 with one or more wire management holes 40 formed therein. Each of the wire management holes 40 is sized and shaped to receive a wire routing grommet assembly 42, which are also described below. This arrangement provides convenient wire management for electrical components 44 located on the shelves 36 of the stack on hutch unit 16.

Figure 2:
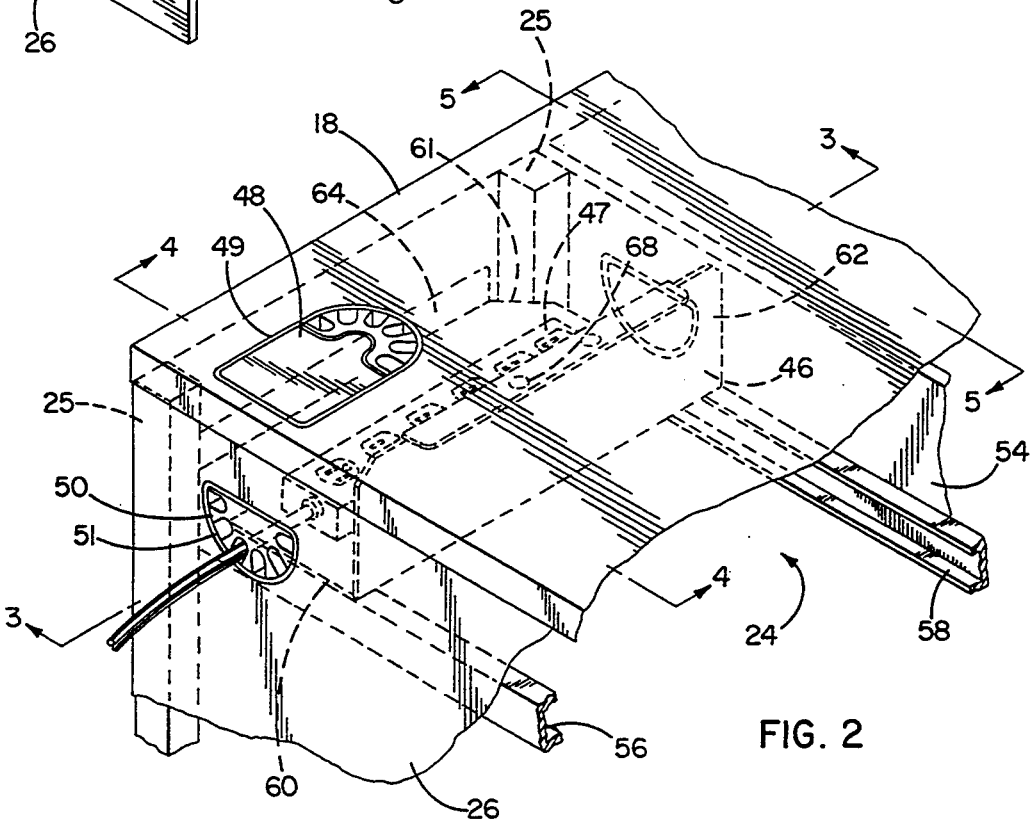
FIG. 2 is an isometric view of a wire management assembly used in the wiring management system of FIG. 1.

FIG. 2 illustrates the components of the wire management assembly 10 of this invention as well as structural components of the pedestal assembly 24 in greater detail. The wire management assembly 10 comprises a support tray structure 46 which provides a location for placement of an electrical appliance 47, such as an electrical power strip with multiple receptacles for supplying power to various locations in the desk unit 8 or another useful and suitably sized appliance. The assembly 10 also comprises a first wire guide insert subassembly 48 disposed in an opening 49 formed in the desk top 18 and facing upward from the presented surface of the desk unit 8. This wire guide insert subassembly 48 provides convenient positioning and separation of individual wires to allow the wires to pass therethrough as well as a large access opening for ready hand access by the user to the interior of the desk unit 8 and to the electrical appliance. In addition, the wire management assembly 10 includes at least one generally D-shaped wire guide insert subassembly 50 disposed in an opening 51 formed in the side panel 26 which likewise provides convenient positioning and separation of a plurality of individual wires 12. In the preferred embodiment, a plurality of D-shaped wire guide inserts 50 are employed for providing wire pass through the side panels 26 and other vertical panels of the desk unit 8.

Figure 3:
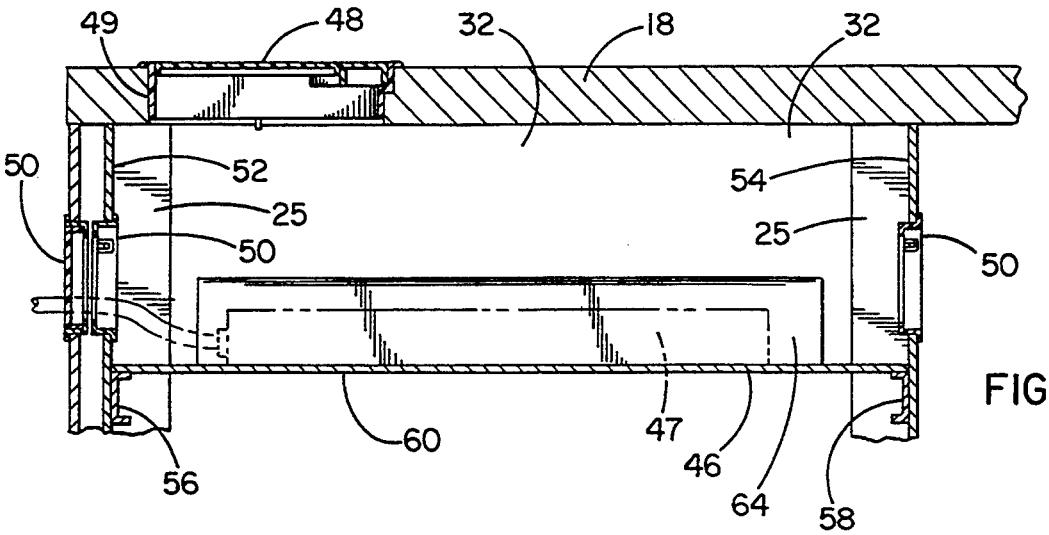
FIG. 3 is a section view of the wire management assembly of FIG. 2 taken along the lines 3—3.
Figure 4:
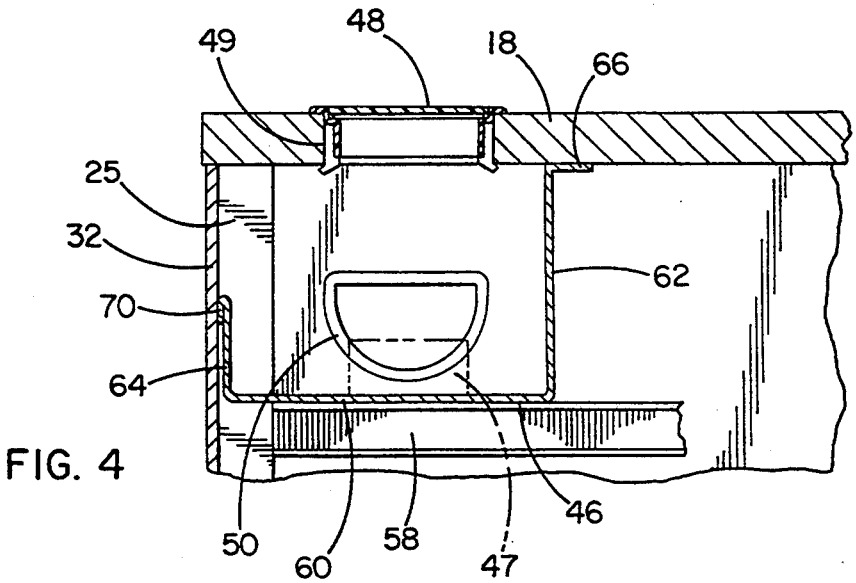
FIG. 4 is a section view of the wire management assembly of FIG. 2 taken along the lines 4—4.
Figure 5:
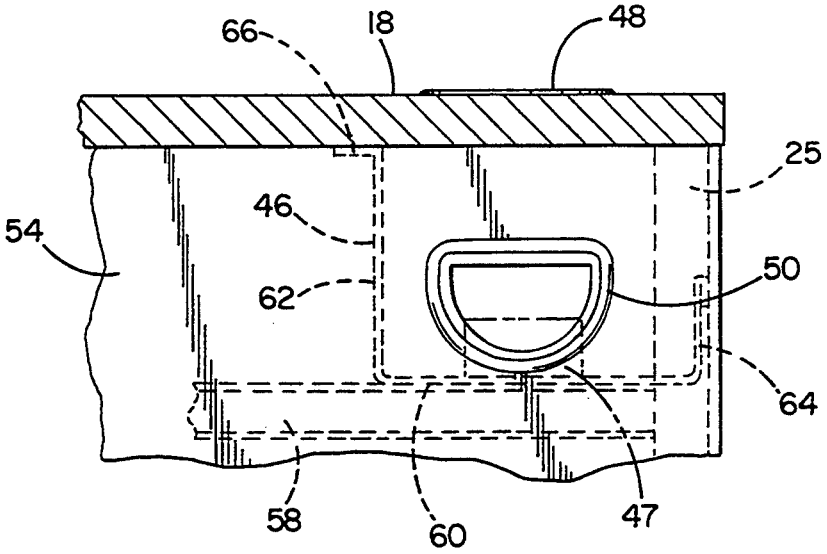
FIG. 5 is another section view of the wire management assembly of FIG. 2 taken along the lines 5—5.

As best seen in FIGS. 3–5, the supporting tray structure 46 is sized for placement within the pedestal assembly 24. In this regard, the pedestal assembly 24 forms a rectangular cabinet with first and second opposed sidewalls 52 and 54 and the back panel 32. The upper and lower pedestal drawers 28 and 30 are slideably mounted on C-shaped drawer channels located on the pedestal side walls 52 and 54 with the use of conventional drawer slides (not shown). FIGS. 2–5 illustrate drawer channels 56 and 58 for slideably engaging the upper drawer 28 which traverse the lengthwise dimension of the pedestal assembly 24 although the upper drawer 28 is of a depth somewhat less than the lower drawer 30 and of the pedestal assembly 24. FIGS. 2 and 3 also illustrate vertical structural legs 25, located in opposed rear corners of the pedestal assembly 24, for providing structural support to the desk unit 8.

The supporting tray 46 comprises a bottom piece 60, a front piece 62 and a rear piece 64 preferably formed from a single piece of sheet metal. The bottom piece 60 preferably spans the width-wise dimension of the pedestal 24, substantially contiguous with the pedestal side walls 52 and 54. The bottom piece 60 is further located on and is supported by the upper drawer channels 56 and 58. For this reason, the bottom piece 60 includes cut out portions 61 (see FIG. 2) to accommodate the vertical structural legs 25. A horizontal flange 66 is located on the distal end of the front piece 62 of the supporting tray 46. The flange 66 includes one or more holes 68 (FIG. 2) for receiving securing screws which are threaded into the underside of the desk top 18. In this way, the flange is secured to and is flush with the underside surface of the desk top 18. As best seen in FIG. 4, the rear piece 64 of the supporting tray 46 preferably includes a lip 70 that engages a notch (not shown) formed in the back wall 32 of the pedestal 24 to further secure the supporting tray. It should be noted, however, that primary support for the supporting tray 46 is provided by the opposed upper drawer channels 56 and 58 upon which the supporting tray bottom piece 60 rests.

Inasmuch as the supporting tray 46 forms an enclosure with its bottom piece, front and rear pieces, and the contiguous pedestal side walls 52 and 54, the electrical appliance 47 as well as any wiring 12 within the pedestal assembly 24 is captured within the enclosure. This arrangement advantageously isolates the wiring and related electrical apparatus from other portions of the pedestal assembly 24 or of the desk unit, in particular the sliding drawers or other movable elements, which may otherwise crimp or sever the electrical wiring. Likewise, this arrangement reduces the risk of inadvertent contact of the wiring by users.

The main structural details of the top wire guide insert subassembly 48 are best seen in FIGS. 8–12. As illustrated therein, the subassembly 48 includes a generally closed U-shaped grommet or wire guide frame 72 molded from a plastic material. The grommet 72 is defined by a rounded end 74, first and second parallel sides 76 and 78, and a removable square end 80 bridging the legs of the U. The grommet 72 includes an upper lip 82 that extends somewhat outwardly from the body of the grommet 72. The upper lip 82 is designed to protrude beyond the top opening in which the grommet 72 is placed, but is substantially flush with desk top surface. The height of the grommet 72 is approximately the same as the thickness of the desk top 18. As seen in FIG. 4 and also FIG. 8, the grommet frame sides 76 and 78 include downwardly extending legs 84, each having an oppositely facing latch ear 86 that extends beneath the desk top 18 when the grommet frame is inserted within the top opening 49. In this position, the opposed latch ears 86 engage the bottom surface of the desk top 18 and retain the frame 72, in cooperation with the upper lip 82, in snap latch retention with the desk top 18.

The inner surfaces of the rounded end 74 and parallel sides 76, 78 of the grommet frame 72 have a ledge 88 formed therein for receipt of removable cover elements. The ledge 88 has a somewhat smaller depth along the sides 76, 78 of the grommet than the ledge depth along the rounded end 74. The ledge 88 further includes a stepped segment 90 located at approximately the intersection of the sides 76, 78 and the rounded end 74 with a depth intermediate the side ledge depth and the rounded end ledge depth. In addition, a plurality of notches 92 are formed about the periphery of the ledge 88 along the rounded end 74.

Figure 8:
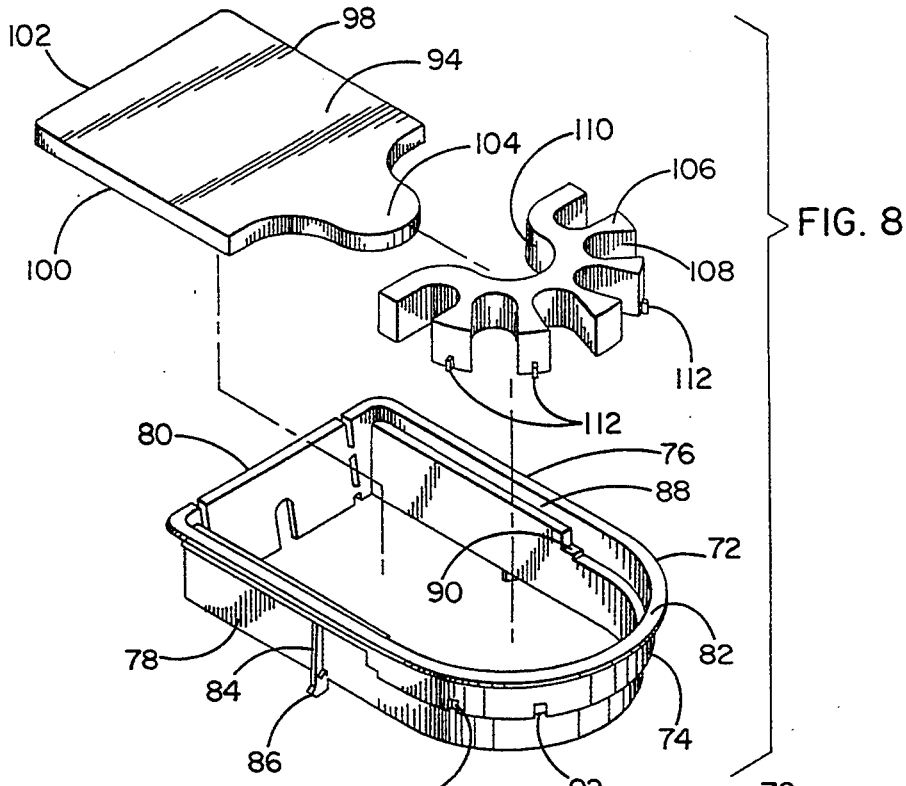
FIG. 8 is an exploded view of a wire guide insert subassembly used in the wire management assembly of FIG. 2.
Figure 9:
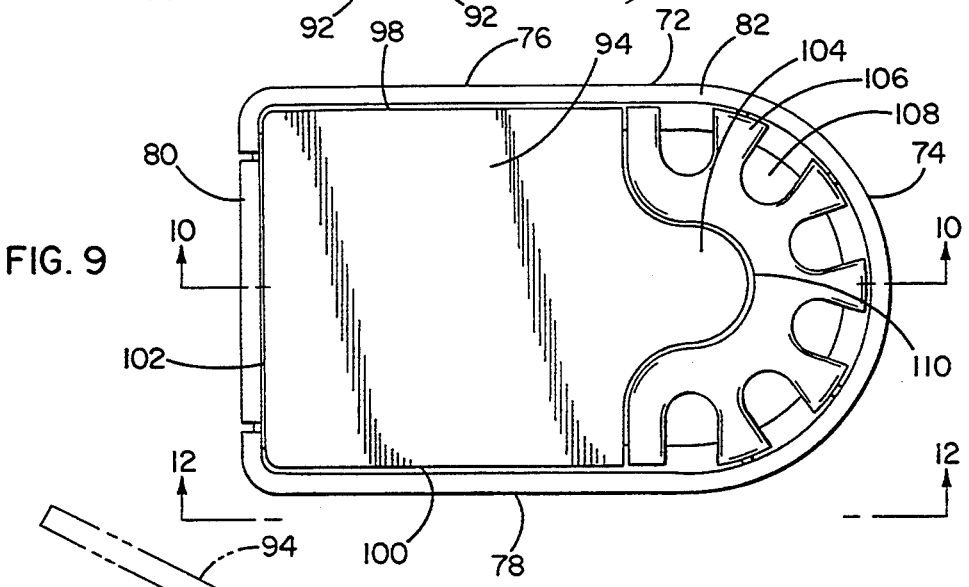
FIG. 9 is a plan view of the wire guide insert subassembly of FIG. 8 when fully assembled.

FIGS. 8 and 9 also illustrate the details of the removable closure elements, including a cover piece 94 and a rosette piece 96. The cover piece 94 is defined by parallel sides 98, 100 and an end 102 sized for placement within the grommet frame 72. When placed therein, the sides 98, 100 rest on the ledge 88 formed in the grommet frame sides 76, 78 to maintain the cover piece 94 in place. The cover piece 94 is further defined by a curved tongue portion 104 which provides a finger-engageable surface for the cover piece 94.

The rosette piece 96 is a comb-like structure having a plurality of equispaced teeth 106 formed in a semicircular pattern about the outer periphery of the piece. Adjacent teeth 106 are separated by complementary grooves 108 adapted to have individual wiring threaded therethrough. These grooves 108 provide individual wire pass through locations to thereby provide neat and convenient positioning of individual wires, avoiding desk clutter and tangling of the wires. The rosette piece 96 also includes a groove 110 to receive and mate with the tongue portion 104 of the cover piece 94.

The rosette piece 96 adapted to interfit within the channel 88 formed in the rounded end 74 of the U-shaped grommet frame 72. In order to remain secured therewithin, a plurality of interlocking tabs 112 are formed in the outer surface of the teeth 106 to engage with complemental notches 92. In this regard, the grommet frame 72, when made of molded plastic, is pliable in nature and provides sufficient resiliency such that tabs 112 may be interfit within respective notches 92, but also develops adequate rigidity when placed within the top opening 49 of the desk unit 8.

Figure 10:
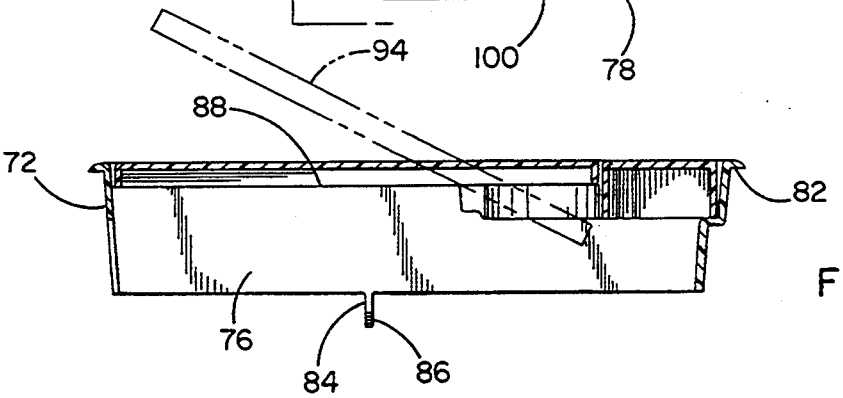
FIG. 10 is a section view of the wire guide insert subassembly of FIG. 9 taken along the lines 10—10.
Figure 11:
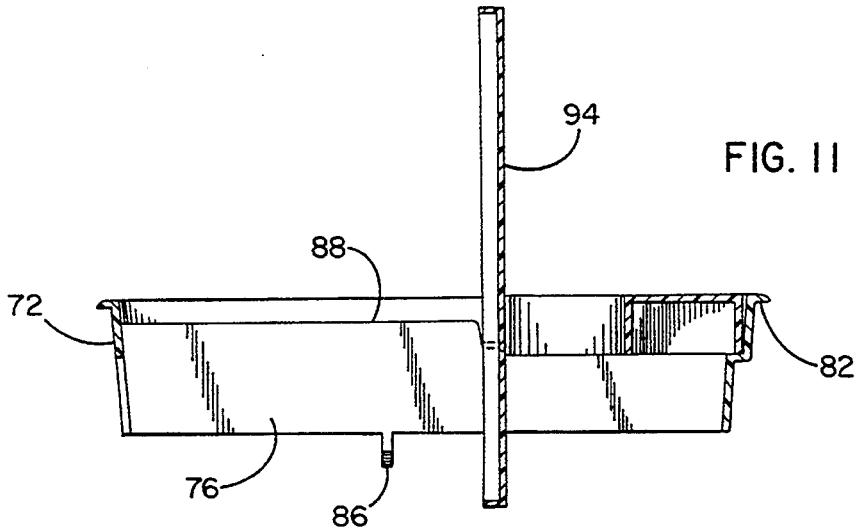
FIG. 11 is a section view of the wire guide insert subassembly of FIG. 8 illustrating a cover piece in an upright position for permitting access to the interior of the furniture component.
Figure 12:
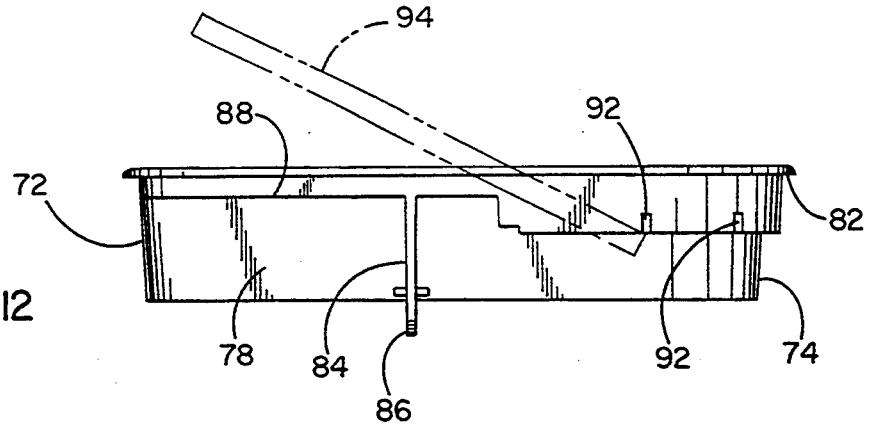
FIG. 12 is a section view of the wire guide insert subassembly of FIG. 9 taken along the lines 12—12.

The operation of the cover piece 94 is readily seen in FIGS. 10–12. As best seen in FIG. 10 and also FIG. 12, depression of the finger-engageable tongue portion 104 rotates the cover piece 94 about a pivot formed by the stepped configuration of the frame channel. Such action rotates the cover piece 94 to any desired position and ultimately to an upright position, as illustrated in FIG. 11. In this position, the cover piece 94 rests on the channel stepped segment 90. The cover piece 94 may also be readily removed from the grommet frame 76. This provides a large opening for ready hand access by the user thereby permitting, for example, reaching into the desk unit to turn the electrical appliance on or off, or turning one or more of the connected electrical equipment on or off.

Likewise, the rosette piece 96 is readily removable by disengaging the locking tabs 112 from respective notches 92 and removing the rosette piece 96 from the grommet 72. Thus the large top grommet structure provides two separate selectively removable closure panels for maximum space for insertion and removal of appliances and for special access to other apparatus supported by the tray 46 or for other circumstances.

Figure 13:
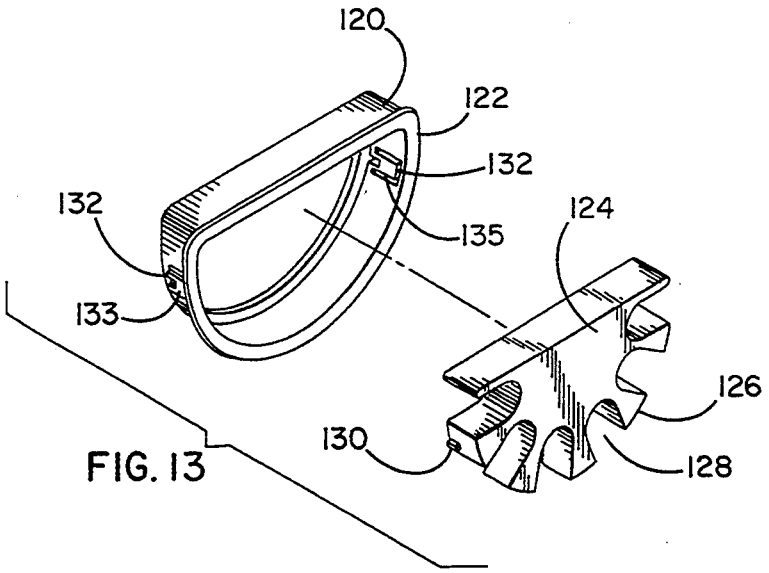
FIG. 13 is an exploded view of a wire guide insert subassembly according to a second embodiment of the present invention.
Figure 14:
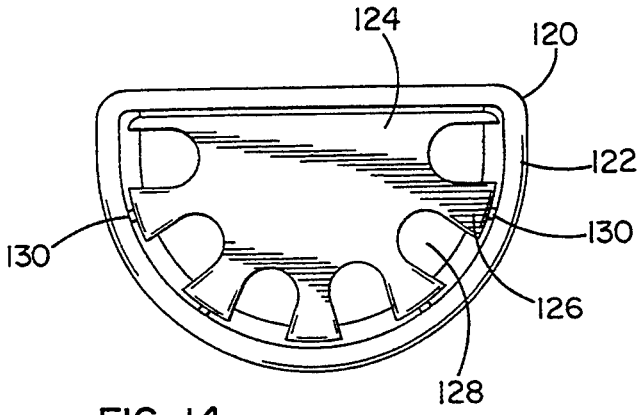
FIG. 14 is a plan view of the wire guide insert subassembly of FIG. 13.

Turning now to FIGS. 13–14, the D-shaped wire guide insert subassembly 50 is shown there in greater detail. This subassembly 50 also includes a grommet frame 120 preferably formed from a plastic material. The grommet frame 120 has a generally D-shaped configuration preferably sized for placement within an opening formed in the side wall of the desk unit 8. In the preferred embodiment, a D-shaped wire guide 50 is located in the openings formed in the pedestal side walls 52 and 54 contiguous with the supporting tray structure 46 (see FIG. 3). Likewise, such a wire guide 50 is located in the opening 51 formed in the desk side wall 26.

The thickness of the D-shaped grommet frame 120 is somewhat less than the thickness of the U-shaped frame 72 described above in connection with the top wire insert guide. However, the thickness of the frame 120 is sufficiently greater than the panel thickness in which it is placed so that the wiring is protected from the edge of the panel which can present a sharp surface. In the preferred embodiment, the thickness of the D-shaped frame 120 is approximately 0.25 inches. The grommet frame 120 likewise includes an outer lip 122 which protrudes slightly beyond the outer side wall surface 26 of the desk unit 8 when placed within the side opening, but is substantially flush with the side wall surface.

The D-shaped wire guide subassembly 50 also includes a rosette piece 124 which is similar in structure and functions in a similar fashion as the rosette piece described above in conjunction with the top wire guide insert. The rosette piece 124 is also comb-like structure having a plurality of equispaced teeth 126 disposed in a semicircular pattern about a portion of its outer periphery. Adjacent teeth 126 are separated by complementary grooves 128 adapted to receive wiring therethrough to provide individual wire pass through locations.

The rosette piece 124 further includes a pair of interlocking latch tabs 130 on the outer periphery of the teeth adapted to engage mating portions of the grommet 120. This arrangement is best seen in FIG. 13, wherein the grommet 120 is shown with a pair of molded latch arms 132 joined to the grommet at a point of connection opposite the rosette piece 124. Each of these latch arms 132 carry an upper latch lip 133 on its outside surface to provide latch engagement upon passage through the side opening in the metal. In addition, the inner surface of each of the latch arms 132 is bezeled and includes a receiving detent 135 in the lower portion of the arm adapted to interfit with the latch tabs 130. Thus, when the rosette piece 124 is slideably placed within the grommet 120, the rosette piece teeth 126 and interlocking tabs 130 apply a camming action to the latch arms 132 to lock the grommet frame 120 in place. In addition, they abut the inner surfaces of the latch arms 132 to thereby tend to preclude inadvertent unlatching engagement and release of the outer grommet 120.

However, the D-shaped wire guide 50 may also be employed without the use of the rosette piece 124 to provide wiring pass through the desk unit 8. In this instance, the grommet 120 is secured in a complementary opening by interlocking engagement of the upper latch lip 133 with the side opening. This configuration is particularly suited for passage of wiring through interior walls of the desk unit, such as pedestal side walls 52 and 54, as seen in FIGS. 4 and 5. The rosette piece 124 is typically utilized wherever it is desired to carry one or more wires outward of the desk unit 8.

Turning back to FIGS. 6 and 7, therein is shown the novel attachment of the stack-on hutch unit 16 to the desk unit 8. The hutch unit 16 is preferably provided with vertical legs 34 including a shallow C-shaped inner vertical structure 140 and a mating C-shaped post cover panel 142. As seen in FIG. 6, the inner vertical structure 140 is provided with spaced holes 144 at its ends. The cover panel 142 telescopically engages over the vertical structural panel 140 to provide an outer finished surface. This cover panel 142, however, is preferably sufficiently resilient to be removable to expose the interior of the vertical leg 34 and replaceable by snap action and a direct lateral action. FIG. 6 also shows a cross piece 146 having a U-shaped cross section and complementary holes 148 aligned with the vertical structural panel holes 144 for receiving screws to attach the cross piece 146 to the vertical structural panel 140.

FIGS. 6 and 7 also show the vertical leg 34 disposed proximate to the top opening 49 of the desk unit 8. This enables an attaching bracket 150 to be employed to secure the vertical hutch leg 34 to the desk unit 8. As best seen in FIG. 7, the attaching bracket 150 has an inverted T-shaped base portion 152 including a pair of opposed, laterally extending ears 154. The base portion 154 is dimensioned to span the top opening of the desk unit 8 while the ears 154 project beyond the sides of the opening when installed therein. In addition, the attaching bracket 150 has a shoulder 156 that rests atop the adjacent edge portion of the desk top 18 when the bracket is installed. The attaching bracket 150 further includes a vertical leg portion 158 and a short upper horizontal leg portion 160 having a pair of apertures 162 formed therein. The vertical structural panel 140 fits adjacent the vertical leg portion 158 of bracket 160. The upper horizontal leg portion 160 fits beneath the cross piece 146 such that the apertures 170 are aligned with complementary holes formed in the cross piece 146. In this way, the attaching bracket is joined to the cross piece 146 with suitable attachment means.

When utilizing the hutch structure, the base end 80 is broken away from the top wire guide frame 72, as seen in FIG. 7, providing an exposed desk top edge area of the respective opening 49 of the desk top 18. The attaching bracket 150 is positioned by extension into the opening 49 with the base portion 152 extending longitudinally of the opening 49 and turning sideways and fitting against the square end of the opening as illustrated in FIG. 6. In this position, the opposed ears 154 engage beneath the desk top at each side of the opening 49. The base portion 152 further includes a hole 164 for reception of a retainer screw for purposes of maintaining the attaching bracket in position. However, the vertical load is carried by the bracket shoulder 156.

Figure 15:
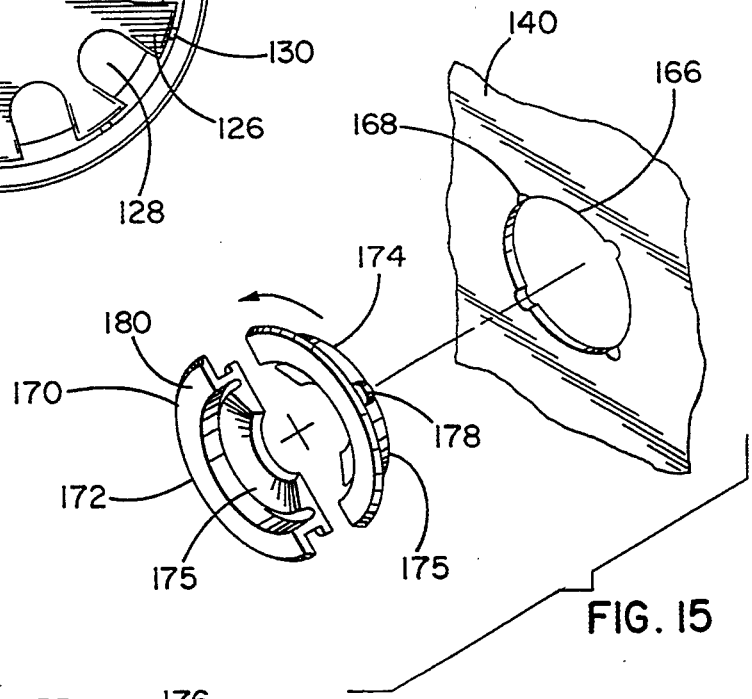
FIG. 15 is an exploded view of a grommet assembly and vertical panel according to yet another embodiment of the present invention.

FIG. 6 also illustrates at least one wire management hole 166 in the vertical structural post 140 of the hutch unit 16, but as shown therein, typically the vertical post contains a plurality of wire management holes. These wire management holes 166 provide routing for electrical wiring to electronic apparatus located on the hutch shelves 36. The configuration of the wire management hole 166 is best seen in FIG. 15. As shown therein, the wire management hole 166 includes four spaced notches 168 formed about the outer circumference of the hole 166.

Figure 17:
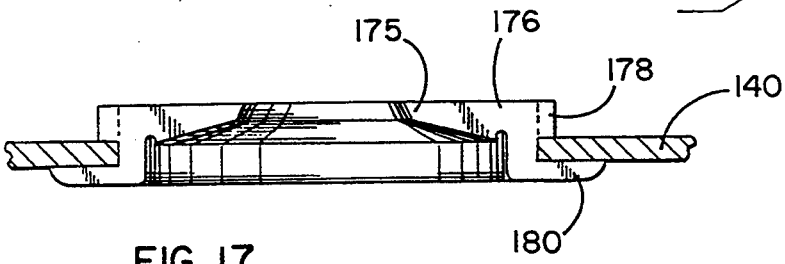
FIG. 17 is a section view of the grommet assembly of FIG. 16 taken along the lines 17—17.

FIG. 15 further shows a wire directing grommet 170 formed from two identical rounded half pieces 172 and 174 fabricated of molded plastic. The rounded pieces provide an O-ring base 175 with an inner radial portion thereof sized to receive a wire when the half pieces are mated. Spaced ribs 176 (see FIG. 17) extend radially from the base 175 to form latching knobs 178 which protrude at the four ordinal points of the base of the wire directing grommet 170. These latching knobs 178 provide ready mounting of the grommet 170. The base 175 may also include spaced nubs (not shown) about its periphery to provide thickness compensation to the grommet pieces when inserted within the hole 166. The grommet pieces 172, 174 also include an outer peripheral flange 180 that provides a finished surface to the exterior of the vertical structural post 140 as well as retention of the grommet 170. In this regard, the grommet 170 is secured in place by engagement of the flanges 180 on one surface of the vertical structural post 140 and engagement of the knobs 178 on the opposite side in the locked position.

Figure 16:
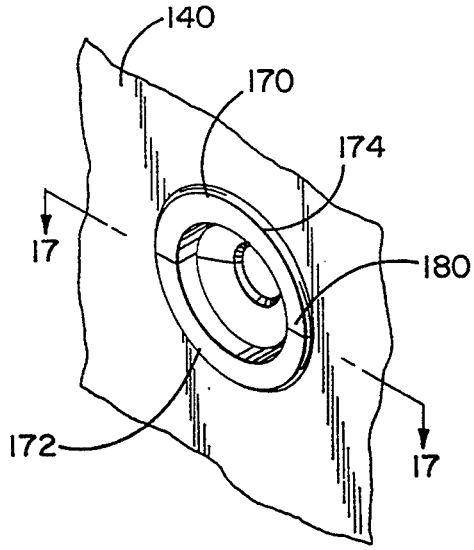
FIG. 16 is an isometric view of the grommet assembly of FIG. 15 mounted within the vertical panel.

In order to secure the grommet 170 within the wire management hole 166, the half pieces 172 and 174 are mated around the wire and brought within contacting relation with each other. The latching knobs 178 are aligned with and inserted into the complemental notches 168 formed in the wire management hole 166. The grommet pieces 172, 174 are then rotated approximately 45 degrees into a locked, retained position, as shown in FIG. 16. In this position, the slot formed by the grommet pieces is parallel with the desk top surface and with the floor. The wire grommet 170 can be removed by counterrotation of the grommet pieces to permit passage of an enlarged portion of the wiring such as a molded plug or the like and then replaced or reused when removed from the wire management hole 166.

Various advantages flow readily from the above described wire management design. For example, a larger access of opening is provided for installation, removal or maintenance of an electrical appliance on the subjacent support directly through the desk top opening. Likewise, the concealed wiring and electrical appliance are effectively isolated from other portions of the desk unit. At the same time, the wire management design eliminates desk clutter and crossed or tangled wiring while providing a relatively neat exposed surface. In addition, the wire management system provides desk-to-desk connection possibilities in which adjacent desks or other office units may have electrical power or other electrical wiring routed thereto using the assemblies described above.

As set forth above, an improved wiring management system and assemblies used therein has been described. Various interconnections and modifications as would be apparent to one of ordinary skilled in the art and familiar with the teaching of this application are deemed to be within the scope of this invention. The precise scope of the invention is set forth in the appended claims, which are made, by reference, a part of this disclosure.

What is claimed is:

1. A wire management system for use in a furniture component having a top surface with at least one top opening and peripheral sides with at least one side opening comprising:

a support structure disposed proximate the top opening and the side opening for supporting an electrical appliance;

a first removable cover member disposed in the top opening including first and second interengaged cover portions, said first cover portion being removable from said top opening for providing access to the electrical appliance and said second cover portion being independently removable from said top opening and having at least one groove therein for routing electrical wiring to a first desired location; and a second removable cover member disposed in the side opening having at least one groove for selectively routing wiring to a second desired location.

2. The wire management system of claim 1 further comprising:

a grommet frame having an outside and an inside surface, said outside surface located within the top opening, said inside surface including a ledge formed along at least a portion thereof having a first depth and a second depth, the junction of said first and second depths of said ledge providing a pivot, said first cover member being adapted for placement within said inside surface of said grommet frame, said first cover portion including a body portion disposed on one side of said pivot and a finger-engageable tongue portion disposed on the opposite side of said pivot, said first cover portion being removable by engagement of said tongue portion to rotate said body portion of said first cover portion about said pivot to gain access to the interior of the furniture component.

3. The wire management system of claim 2 wherein said second cover portion comprises a rosette piece located within a portion of said ledge of said grommet frame, said rosette piece including a plurality of teeth and complemental grooves, said teeth being arranged about a portion of the outer periphery of said rosette piece with adjacent ones of said teeth being separated by one of said complemental grooves for providing a plurality of locations to direct individual wires therethrough.

4. The wire management system of claim 1 further comprising: a grommet frame disposed within said side opening and a generally D-shaped body sized for placement within the grommet frame, said D-shaped body having a plurality of teeth and complemental grooves, said teeth being arranged about the outer periphery of said body with adjacent ones of said teeth being separated by said complemental grooves, each of said complemental grooves providing a location for pass through of an individual wire.

5. The wire management system of claim 1 wherein said furniture component includes a super structure having first and second vertical legs mounted to said top surface, said wire management system further comprising:

wire pass through means located in said first vertical leg for selectively routing wiring to a third selected location.

6. The wire management system of claim 5 further comprising: a generally U-shaped grommet frame with a closed end, said grommet frame including a U-shaped portion and a removable closed end being adapted for placement within said top opening formed in the furniture component.

7. The wire management system of claim 6 wherein said first vertical leg is located proximate to said top opening, said system further comprising:

attaching bracket means for joining said first vertical leg with said furniture component, said attaching bracket means having a base portion with at least one latch ear at a distal end of said base portion, said base portion adapted for placement within said top opening when said closed end of said grommet frame is removed with said at least one latch ear extending through said top opening to engage the underside of the top of the furniture component.

8. The wire management system of claim 5 wherein said vertical leg includes a first panel with an opening with spaced notches formed therein, and wherein said wire pass through means comprises first and second mated grommet pieces adapted to surround an individual wire, each of said grommet pieces including a base with an inner radial portion removed to receive an individual wire when mated together, radial extending latching knobs protruding from said base portion for placement through said spaced notches, and an outer peripheral flange, said grommet pieces being secured within said opening with said latching knobs located on one side of said first panel and said peripheral flange located on the opposed side of said panel.

9. A wire guide insert assembly for providing selective access to the interior of a furniture component comprising:

a grommet frame having an outside and an inside surface, said outside surface located within an opening formed in the furniture component, said inside surface including a ledge formed along at least a portion thereof having a first depth and a second depth, the junction of said first and second depths of said ledge providing a pivot;

wire guide pass through means disposed within a portion of said inside surface of said grommet frame for providing a plurality of locations to direct individual wires therethrough; and a cover piece adapted for placement within said inside surface of said grommet frame, said cover piece including a body portion disposed on one side of said pivot and a finger-engageable tongue portion disposed on the opposite side of said pivot, said cover piece being removable by engagement of said tongue portion to rotate said body portion of said cover to gain access to the interior of the furniture component.

* * * * *